United States Patent [19]

Nakahara et al.

[11] Patent Number: 4,714,253

[45] Date of Patent: Dec. 22, 1987

[54] THREE-PIECE SOLID GOLF BALL

[75] Inventors: Akihiro Nakahara, Ibaraki; Taketo Matsuki, Nishinomiya, both of Japan

[73] Assignee: Sumitomo Rubber Industries, Ltd., Hyogo, Japan

[21] Appl. No.: 774,452

[22] Filed: Sep. 10, 1985

Related U.S. Application Data

[63] Continuation-in-part of Ser. No. 602,165, Apr. 19, 1984, abandoned.

[30] Foreign Application Priority Data

Apr. 21, 1983 [JP] Japan ..... 58-70811

[51] Int. Cl.[4] ..... A63B 37/06

[52] U.S. Cl. ..... 273/228; 273/230

[58] Field of Search ..... 273/218, 220, 230, 219, 273/225, 228, 229

[56] References Cited

U.S. PATENT DOCUMENTS

| | | | |
|---|---|---|---|
| 3,438,933 | 4/1969 | Bartsch | 273/218 X |
| 3,553,159 | 1/1971 | Miller et al. | 273/218 X |
| 4,141,559 | 2/1979 | Melvin et al. | 273/220 |
| 4,650,193 | 3/1987 | Molitor et al. | 273/228 |

FOREIGN PATENT DOCUMENTS

| | | | |
|---|---|---|---|
| 1095615 | 12/1967 | United Kingdom | 273/220 |

*Primary Examiner*—George J. Marlo

*Attorney, Agent, or Firm*—Birch, Stewart, Kolasch & Birch

[57] ABSTRACT

The present invention provides a three-piece golf ball having an excellent rebound coefficient without any damage to the durability of the golf ball by controlling the diameters, the specific gravities and the hardnesses of central core and outer layer of the solid core.

The golf ball of the present invention is a three-piece solid golf ball produced by covering a two-piece solid core made of a resilient elastomeric material, composed of a central core and an outer layer, with a cover made of an impact and wear resistant material, in which:

(1) the central core has a diameter of 20 to 32 mm and a specific gravity of 1.03 to 1.25, and the hardness (Shore C) of the central core is within the range of 57 to 80 at its center and is larger than that of its center but not more than 83 at a distance between 5 mm and 10 mm from its center, and (2) the outer layer has a diameter of 36 to 40 mm, a specified gravity of 1.30 to 2.50 and a hardness (Shore C) of 70 to 83.

6 Claims, 1 Drawing Figure

THREE-PIECE SOLID GOLF BALL

RELATED APPLICATION

This application is a continuation-in-part of co-pending application, Ser. No. 602,165 filed on Apr. 19, 1984, now abandoned.

FIELD OF THE INVENTION

The present invention relates to a three-piece solid golf ball.

BACKGROUND OF THE INVENTION

A two-piece solid golf ball developed to improve the durability of thread wound golf balls, that is, a solid golf ball produced by covering an integrally molded solid core with a cover having excellent cutting resistance (for example, a cover made mainly of an ionomer resin produced by combining metallic ions to ethylene copolymers), has been found to possess an unsatisfactory rebound characteristic. The rebound characteristic largely affects the initial velocity of the ball and is an important property for governing the flight distance of the ball. Accordingly its improvement is necessary.

For a further improvement in the rebound characteristic of the two-piece solid golf ball, methods of improving the rebound characteristic of the solid core or increasing the moment of inertia of the ball, and the like have been considered. Since, however, the rebound characteristic of the solid core is substantially determined by the co-crosslinking, it is very difficult to improve the rebound characteristic. Also, in order to increase the moment of inertia of the ball, trials are being made to change the hardness distribution and weight distribution in the inside of the ball, but satisfactory results have not been obtained because defects, such as a reduction in durability, tend to appear.

SUMMARY OF THE INVENTION

The present invention provides a three-piece golf ball having an excellent rebound coefficient without adversely affecting the durability of the golf ball by controlling the diameters, the specific gravities and the hardnesses of the central core and outer layer of the two-piece solid core.

DETAILED DESCRIPTION OF THE INVENTION

Figure 1:
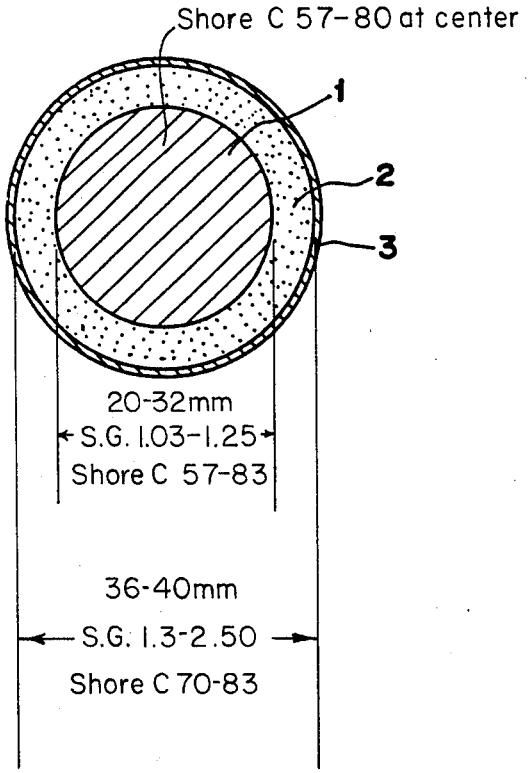

Thus, the present invention provides a three-piece solid gold ball produced by covering a two-piece solid core made of a resilient elastomeric material, composed of a central core and an outer layer, with a cover made of an impact and wear resistant material, in which:

(1) the central core has a diameter of 20 to 32 mm and a specific gravity of 1.03 to 1.25, and the hardness (Shore C) of said central core is within the range of 57 to 80 at its center and is larger than that of its center but not more than 83 at the site between 5 mm and 10 mm apart from its center, and (2) the outer layer has a diameter of 36 to 40 mm, a specified gravity of 1.30 to 2.50 and a hardness (Shore C) of 70 to 83.

Generally, the compositions of the central core and outer layer constituting the solid core of the three-piece solid golf ball according to the present invention are made of the same resilient elastomeric material, but if desired, they may properly be changed within the scope of the present invention.

The component of the solid core includes, for example, substrate rubbers, crosslinking agents, co-crosslinking agents, inactive fillers and the like.

As the substrate rubber, natural rubbers and/or synthetic rubbers conventionally used for solid golf balls may properly be used, but in the present invention, 1.4-polybutadiene rubbers having a cis-structure in a proportion of at least not less than 40% are particularly preferred. If desired, however, natural rubbers, polyisoprene rubbers, styrene/butadiene rubbers or the like may properly be blended with the polybutadiene rubber.

As the crosslinking agent, there are given for example organic peroxides (e.g. dicumyl peroxide, t-butyl peroxide), azo compounds (e.g. azobisisobutyronitrile) and the like. Dicumyl peroxide is particularly preferred.

The amount of the crosslinking agent blended is generally 0.5 to 3.0 parts by weight, preferably 1.0 to 2.5 parts by weight based on 100 parts by weight of the substrate rubber.

The co-crosslinking agent is not particularly limited, and as its examples, the metallic salt of unsaturated fatty acids, particularly the zinc or magnesium salt of unsaturated fatty acids having 3 to 8 carbon atoms (e.g. acrylic acid, methacrylic acid) is given. But, zinc acrylate (normal salt) is particularly preferred. The amount of this agent blended is 30 to 40 parts by weight based on 100 parts by weight of the substrate rubber.

As the inactive filler, there are given for example zinc oxide, barium sulfate, silica, calcium carbonate, zinc carbonate and the like, of which zinc oxide is popularly used. The amount of the filler blended is governed by the specific gravity of the central core and outer layer, the standardized weight of the ball, etc., being not particularly limited. Generally, however, the amount is 3 to 150 parts by weight based on 100 parts by weight of the substrate rubber.

A composition for the central core obtained by blending the components described above is kneaded on the common kneaders such as banbury mixer, rolls, etc., and forced into a mold for the central core by compression or injection molding. The molded product is then heat-cured at a sufficient temperature for the crosslinking and co-crosslinking agents to act (for example, at about 150° C. to about 170° C. when the crosslinking agent is dicumyl peroxide and the other agent is zinc acrylate) to prepare the central core having a diameter of 20 to 32 mm and a specific gravity of 1.03 to 1.25.

In this case, it is important to properly regulate a heat-curing condition (for example, temperature-increasing rate, heating temperature, heating time) so that the central core has such a hardness (Shore C) distribution that the hardness of its center is 57 to 80 and that of a range between 5 mm and 10 mm apart from the center is larger than that of the center but not more than 83. Generally, Shore C hardness is measured by pricking a flat surface of a rubber material with a needle of a Shore C harness meter. Thus, the measurement of the central core is carried out by cutting the central core to form a hemisphere and measuring the hardness of the flat surface thereof.

When the specific gravity of the central core is made less than 1.03 it is almost impossible in terms of blending, while when said specific gravity is more than 1.25, the specific gravity of the outer layer approaches or becomes less than that of the central core, because of which the effect of the present invention cannot be obtained.

Unless, the hardness distribution of the central core satisfies the foregoing condition, the expected object of the present invention cannot be attained.

The solid core of the golf ball according to the present invention is formed by applying an outer layer onto the central core prepared as above.

A composition for the outer layer obtained by blending and kneading the foregoing components is forced into a mold by compression or injection molding, when it is applied concentrically onto the central core in the mold. This two-layer molded product is then heat-cured at a sufficient temperature for the crosslinking and co-crosslinking agents blended in the outer layer to act to obtain a two-piece solid core of 36 to 40 mm in diameter.

Generally, the specific gravity of the outer layer is made 1.30 to 2.50, and the hardness (Shore C) thereof is made 70 to 83, preferably 72 to 75.

The two-piece solid core obtained as above is then covered with a cover, made of an impact and wear resistant material, of 1.4 to 2.7 mm in thickness. As the cover, those which are made mainly of an ionomer resin and if necessary, contains an inorganic filler (e.g. titanium dioxide, zinc sulfate) for the purpose of coloration, etc., are commonly used.

Preferred ionomer resins are thermoplastic resins obtained by giving a cross metallic bond to polymers of monoolefins with at least one member selected from the group consisting of unsaturated mono- or di-carboxylic acids having 3 to 8 carbon atoms and esters thereof (said polymer contains 4 to 30 wt.% of the unsaturated mono- or di-carboxylic acid and/or the ester thereof). As the type of ionomer resin, there are given, for example, various kinds of "Surlyn" resins marketed by Du Pont Co. (e.g. Surlyn 1601, 1707, 1605, etc. or their combination).

A method for covering the solid core with the cover is not particularly limited. Generally, the solid core is wrapped with two pieces of a cover molded in semi-spherical shell form, and then subjected to heat-pressure molding. But, the solid core may be wrapped by injection-molding the cover composition around it.

The three-piece solid golf ball of the present invention is a solid golf ball retaining durability equal to that of the conventional two-piece solid golf ball as well as having an improved rebound characteristic as compared with the prior art. In addition, the three-piece solid golf ball of the present invention is good in shot feeling, because the shock load at time of hitting is reduced and closely resembles the conventional balata wound golf ball.

The present invention will now be illustrated with reference to the following examples.

EXAMPLE 1

A composition for central core prepared according to the recipe in Table 1 was kneaded on a kneading roll and then pressure-molded at 160° C. for 20 minutes to prepare a solid central core of 28.0 mm in diameter.

A composition for outer layer, as blended according to the recipe in Table 1 and kneaded, was concentrically applied onto the central core by injection molding. This two-layer molded product was heat-treated at 165° C. for 25 minutes to obtain a two-piece solid core.

The obtained two-piece solid core was wrapped with two pieces of a cover in semi-spherical shell form (about 2 mm in thickness) prepared according to the recipe in Table 1, and pressure-molded at 155° C. for 15 minutes to obtain a three-piece solid golf ball of 41.3 mm in diameter.

The physical property of the produced ball is shown in Table 1.

TABLE 1

| | | | | Example | | Comparative example | | |
|---|---|---|---|---|---|---|---|---|
| | | | | 1 | 2 | 1 | 2 | 3 |
| Solid core | Composition of central core (part by weight) | | Cis 1,4-polybutadiene (1) | 100 | 100 | 100 | 100 | 100 |
| | | | Zinc acrylate | 36 | 36 | 36 | 36 | 36 |
| | | | Zinc methacrylate | 3.4 | 3.4 | 3.4 | 3.4 | 3.4 |
| | | | Zinc oxide | 4.5 | 32.8 | 50.1 | 63.6 | 96.8 |
| | | | Dicumyl peroxide | 1.0 | 1.0 | 1.0 | 1.0 | 1.0 |
| | | | Antioxidant | 1.0 | 1.2 | 1.2 | 1.3 | 1.4 |
| | Composition of Outer layer (part by weight) | | Cis 1,4-polybutadiene | 100 | 100 | | 100 | 100 |
| | | | Zinc acrylate | 36 | 36 | | 36 | 36 |
| | | | Zinc methacrylate | 3.4 | 3.4 | | 3.4 | 3.4 |
| | | | Zinc oxide | 83.0 | 59.1 | | 36.2 | 15.0 |
| | | | Dicumyl peroxide | 1.0 | 1.0 | | 1.0 | 1.0 |
| | | | Antioxidant | 1.4 | 1.3 | | 1.2 | 1.0 |
| Cover | Composition (part by weight) | | Ionomer resin (2) | 100 | 100 | 100 | 100 | 100 |
| | | | Titanium dioxide | 3 | 3 | 3 | 3 | 3 |
| | Thickness (mm) | | | 2.15 | 2.15 | 2.15 | 2.15 | 2.15 |
| | Hardness (shore D) | | | 68 | 68 | 68 | 68 | 68 |
| Physical property | Hardness distribution (3) | Central core | Center | 59.5 | 73.5 | 71.8 | 76.0 | 78.0 |
| | | | Site 5 mm apart from the center | 69.8 | 77.7 | 75.3 | 79.5 | 79.5 |
| | | | Site 10 mm apart from the center | 76.6 | 78.4 | 79.4 | 80.0 | 81.0 |
| | | | Outer layer | 80.4 | 80.3 | | 79.0 | 78.0 |
| | Diameter (mm) | Central core | | 28.0 | 28.0 | 37.0 | 28.0 | 28.0 |
| | | Outer layer | | 37.0 | 37.0 | — | 37.0 | 37.0 |
| | Specific gravity | Central core | | 1.084 | 1.247 | 1.340 | 1.411 | 1.574 |
| | | Outer layer | | 1.508 | 1.388 | — | 1.266 | 1.146 |
| | Weight (g) | | | 35.5 | 35.6 | 35.6 | 35.7 | 35.7 |
| | Compression (5) | | | 48.8 | 48.7 | 48.8 | 48.9 | 48.8 |
| | Rebound coefficient | | | +0.013 | +0.006 | ±0.000 | −0.007 | −0.022 |
| Physical property of ball | Flight distance (m) | Driver shot (head speed: 45.2 m/s) | Carry | 205.0 | 202.5 | 201.0 | 200.0 | 198.0 |
| | | | Total | 236.7 | 234.1 | 232.3 | 231.5 | 229.0 |
| | | #5 Iron shot (head speed: 37.2 m/s) | Carry | 170.2 | 168.5 | 167.9 | 167.0 | 166.1 |
| | | | Total | 184.0 | 183.0 | 182.2 | 181.8 | 181.5 |
| | rebound coefficient | | | +0.020 | +0.006 | ±0.000 | −0.007 | −0.021 |

TABLE 1-continued

| | Example | | Comparative example | | |
|---|---|---|---|---|---|
| | 1 | 2 | 1 | 2 | 3 |
| Durability index (4) | 100 | 100 | 100 | 100 | 100 |
| Shock load (6) | 92 | 97 | 100 | 104 | 108 |

(1) JSR BR01
(2) A mixture of Surlyn 1601 and Surlyn 1707
(3) Shore C hardness
(4) A measurement value obtained by continuous hammering, as expressed in index with the value on the two-piece solid golf ball as 100.
(5) The deformation of the solid core in mil (mil = 1/1,000 inch). The deformation is measured by initially applying a 3.8 Kg weight to the solid core of the golf ball and then shifting the weight to 43.8 Kg.
(6) An index of shock load in terms of the two-piece golf ball of comparative example 1 of which value of shock load is made 100, measured by shooting a golf ball to be measured at 45 m/s with a golf club equipped with an acceleration meter. The smaller index is the smaller shock load, that is, the more soft. A wound golf ball covered by balata has the index of 90.

EXAMPLE 2

A three-piece golf ball was prepared as generally described in Example 1 by using the charge shown as Example 2 in Table 1.

The physical property of a three-piece solid golf ball is shown in Table 1.

Comparative Example 1

The physical property of a two-piece solid golf ball, as prepared according to the procedure of Example 1 except that the solid core is of a mono-layer structure, is shown in Table 1.

Comparative Examples 2 and 3

Three-piece golf balls were prepared according to the procedure of Example 1 by using the charges shown as Comparative Examples 2 and 3 in Table 1.

The physical property of three-piece solid golf balls is shown in Table 1.

As in shown in Table 1, by adjusting the specific gravity and hardness within the claimed range, the obtained golf ball has an improved rebound coefficient as well as a decreased shock load when it is hit by a club, in comparison with a conventional two-piece golf ball. The conventional two-piece golf ball had a bad feeling at hitting, because the shock load is strong. By the present invention, the shot feeling is approached to a wound golf ball covered by balata.

What is claimed is:

1. A three-piece solid golf ball having high durability and improved rebound characteristics which comprises a two-piece solid center made of a resilient elastomeric material having a central core and an outer layer, and a cover made of an impact and wear resistant material, wherein (1) the central core has a diameter of 20 to 32 mm and a specific gravity of 1.03 to 1.25, with the center point of the central core having a hardness (Shore C) within the range of 57 to 80 with the center core, at a distance between 5 mm and 10 mm from its center point, having a shore hardness higher than that at the center point but not more than 83, and (2) the outer layer has an outer diameter of 36 to 40 mm, a specified gravity of 1.30 to 2.50 and a hardness (Shore C) of 70 to 83.

2. The three-piece solid golf ball of claim 1 wherein the cover has a thickness of 1.4 to 2.7 mm.

3. The three-piece solid golf ball of claim 1 wherein the cover is made of an ionomer resin.

4. The three-piece solid golf ball of claim 1 wherein the resilient elastomeric material is 1,4-polybutadiene rubber having at least 40% of a cis-structure.

5. The three-piece solid golf ball of claim 3 wherein the ionomer resins are thermoplastic resins obtained by crosslinking polyolefins with a metallic bond and with at least one member selected from the group consisting of unsaturated mono- or di-carboxylic acids having 3 to 8 carbon atoms and ester thereof.

6. The three-piece solid golf ball of claim 4 wherein the polybutadiene rubber is blended with natural rubbers, polyisoprene rubbers, and styrene-butadiene rubbers.

* * * * *